United States Patent [19]

Grandmottet

[11] Patent Number: 4,746,031

[45] Date of Patent: May 24, 1988

[54] CASE-TYPE CONTAINER INCLUDING TWO PARTS JOINED AT AN INCORPORATED HINGE

[75] Inventor: André Grandmottet, Pierre de Bresse, France

[73] Assignee: Etablissements Mayet Incorporated, Pierre de Bresse, France

[21] Appl. No.: 63,833

[22] Filed: Jun. 19, 1987

[30] Foreign Application Priority Data

Jun. 20, 1986 [FR] France ..... 86 08974

[51] Int. Cl.[4] ..... B65D 53/00

[52] U.S. Cl. ..... 220/337; 220/338

[58] Field of Search ..... 220/337, 338, 343

[56] References Cited

U.S. PATENT DOCUMENTS 1,635,941 7/1927 Kendall ..... 220/337

4,693,392 9/1987 Contreras, Sr. ..... 220/337

FOREIGN PATENT DOCUMENTS 505980 8/1920 France .

2338671 8/1977 France .

2458243 1/1981 France .

1148240 4/1969 United Kingdom .

*Primary Examiner*—George T. Hall

*Attorney, Agent, or Firm*—Cushman, Darby & Cushman

[57] ABSTRACT

The container is of the type including two pivoting parts, such as a body 1 and a lid 2 which are joined to one another by a swivel joint and which are respectively integrally connected with a cap 3 and a pivot pin 8 constrained to interlock in order to determine a pivoting assembly held in place by an element 11 connected on top of said assembly. It is characterized in that the two pivoting parts 1 and 2 have uninterrupted contours of their outer edges 1*a* and 2*a* and in that the connected element 11 is provided with at least one internal opening 20-21 enabling the passage of arms 9 and 10 which are integrally connected with the pivot pin 8 and with the lid 2, at a substantial distance x from its outer edge 2*a*.

5 Claims, 2 Drawing Sheets

CASE-TYPE CONTAINER INCLUDING TWO PARTS JOINED AT AN INCORPORATED HINGE

BACKGROUND OF THE INVENTION

Swivel joints, especially between a containing body and a lid, are known to be a difficult problem to solve, not only in terms of the manufacturing cost, but also in view of the practical necessities associated with the use of the container.

When the container is in common use, it is possible to make do with simple solutions, and in this case there is generally less preoccupation with the esthetic considerations: boxes, card files, filing cabinets, etc. The opposite situation, which is characterized by strong esthetic constraints, is also encountered: fancy leather goods, bibelots, jewelry, inlaid work, etc., but in that case the production costs become secondary.

Aside from these extreme cases, numerous articles exist in which esthetics and cost must be balanced, and it will be appreciated that this problem is very difficult to solve, since an optimal solution to contradictory requirements must be found.

By way of example, this type of article can be considered to include makeup cases and other accessories intended to be kept in a handbag. In effect, aside from the fact that esthetics are primary, their usage must be simple and their shapes must be modest and smooth, that it, they must not have any angular, pointed, or sharp-edged part or anything likely to snag or catch. Accordingly, and in particular, this hinge must be as unobtrusive as possible.

However, the manufacture of the article and the mounting of the hinge must also be quite simple, so that the cost price will be as low as possible.

Numerous solutions have been proposed, but they do not liberate the designer from strictly geometrical imperatives, which dictate that the pivot pin of the hinge must be straight and must be located as close as possible to one of the sides, or outer edge, of the article. As a result, this side or outer edge must itself be straight and stands in the way of any esthetic attempt to use curved shapes, unless one is willing to move the straight hinge to the other side of the curved contour of the article; but in that case the article becomes less practical, its shapes are assertive instead of being modest, and its overall esthetics are destroyed.

French Patent No. 2.338.671 is known, for example, which describes compact including a body provided with a cap, a lid provided with a pivot pin and an intermediate piece that comes to cover the body and hold the pivot pin. However, the body and the intermediate piece have discontinuous outer edges, with recesses (12 and 16), and contrarily nothing is provided to hide the swivel joint, in particular by shifting it.

French Patent No. 2.458.243 is also known, which is similar to the aforementioned patent and likewise provides that the article has discontinuous outer edges (in this case, a "notch" 6 of the box half 2). This document describes nothing further in terms of shifting the swievel joint.

SUMMARY OF THE INVENTION

The present invention provides a novel solution to this problem making it possible to balance the contradictory requirements of simplicity, low cost price and esthetic freedom, by shifting the swivel joint not toward the outside of the article but toward the inside.

To this end, the subject of the invention is a container of the type that includes two pivoting portions, such as a body and a lid, which are joined to one another by a swivel joint and which are respectively integrally connected with a cap and with a pivot pin constrained to interlock in order to determine a pivoting assembly held in place by an element connected on top of said assembly, characterized in that the two pivoting parts have uninterrupted contours on their outer edges and in that the element connected is provided with at least one internal opening allowing the passage of arms integrally joined to the pivot pin, on the one hand, and to the lid on the other, at a substantial distance from the outer edge of the lid.

According to other characteristics of the invention, (a) the internal opening, or each internal opening as applicable, extends from the internal lower edge of the element connected to this side of its outer edge; (b), the zone of the lid located between the outer edge and the arms is located perpendicular with the opening or openings of the connected element when said lid is in the position of closing; (c) the arms are curved; (d) the connected element is provided with an aperature for each arm.

The invention will be better understood from the ensuing detailed description, referring to the accompanying drawing. It will be understood that the description and the drawing are provided solely by way of descriptive and non-limiting example.

DETAILED DESCRIPTION

Figure 1:
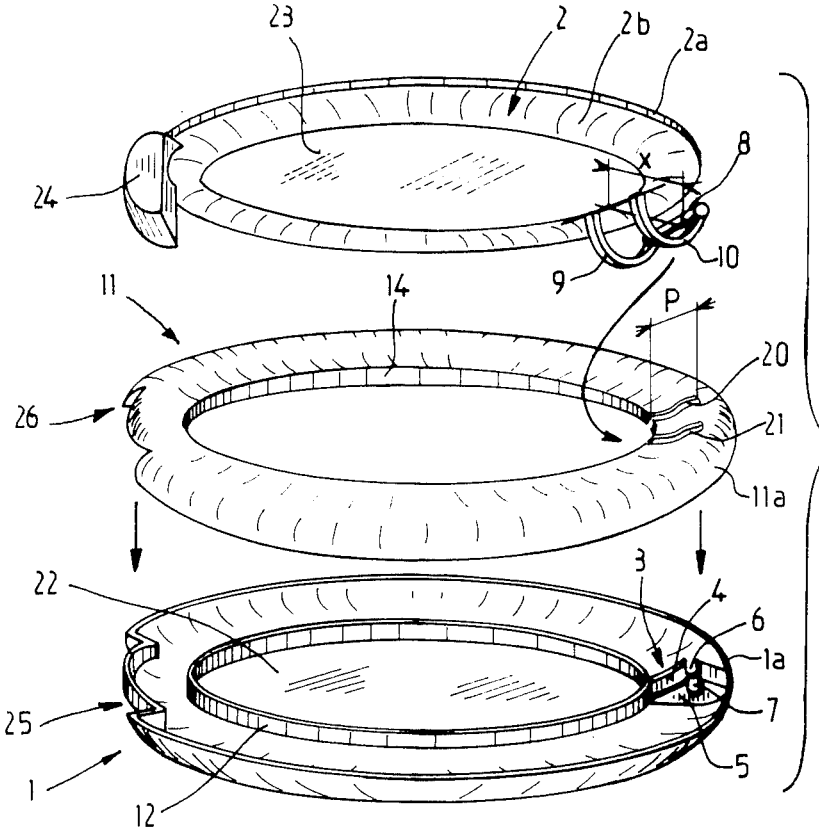
FIG. 1 is a schematic perspective view showing a container according to the invention, the three essential parts of which are shown separate from one another.
Figure 2:
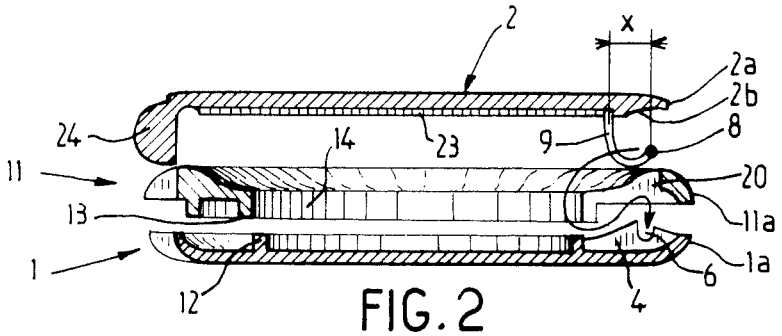
FIG. 2 is a schematic sectional view of the same container, the three essential parts of which are shown superimposed one on the other.
Figure 3:
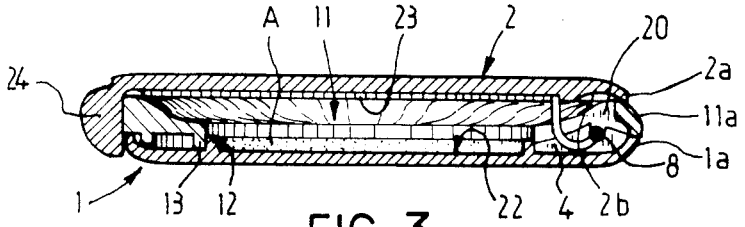
FIG. 3 is a schematic sectional view of the same container, the three essential parts of which are shown after assembly, with the container then being closed.

Turning to the drawing, a container according to the invention is seen, which is in the form of a case, which includes two parts constituted by a body 1 and a lid 2.

The body 1 has a cap 3 comprising two parallel supports 4 and 5, in which two recesses 6 and 7 are provided having the form of a circular arc.

The lid 2 is integrally connected with a cylindrical pivot pin 8 via curved arms 9 and 10, which are located at a distance x from the outer edge 2*a* of the lid 2, such that the fulcrum of the pivoting is shifted farther toward the inside of the lid 2 with respect to the pivot pin 8.

The pivot pin 8 must extend within the two recesses 6 and 7 so as to be able to rotate freely there. To hold the pivot pin 8 in place, an element 11 is provided which must come to cover it, above the cap 3, so that in some manner it forms a complement of the cap 3, and together they clasp the pivot pin 8. The element 11, in order to play its role of holding the pivot pin 8, must be fixed to the body 1 by any known means. Thus the pivot pin 8 and the cap 3 remain engaged but are free to execute a relative pivoting movement, which when it occurs is expressed by the possibility that the lid 2 is capable of opening with respect to the body 1 that is supposed to be held.

In addition to its technical function of holding the pivot pin 8 in the cap 3, the element 11 has an esthetic function, which comprises hiding the swivel joint by at least partly covering it. The more complete this coverage is, the more agreeable the appearance of the container, because the devices making up a swivel joint never actually compete with the esthetics of the assembly. Here, only the arms 9 and 10 are visible.

The outer edges 2*a* of the lid 2, 11*a* of the element 11 and 1*a* of the body 1 are absolutely unbroken and allow no pereception whatever of the presence of a swivel joint when the lid 2 is in the closing position.

The element 11 may be relatively small, since its utilitarian portion (for holding and covering) is localized above the cap 3. However, in an advantageous embodiment of the invention, the element 11 can be realized by lending it a shape and dimensions coordinated with those of the body 1. For example, the element 11 can be used an effect of contrast with the body 1 on which it is fixed. Here, far from being contrasted with respect to the body 1, the element 11 has an identical circular outer contour and an annular shape, leaving its central portion open. If the body 1 and the element 11 are made of the same material and in the same color, a very attractive esthetic effect is obtained, since the body 1 and the element 11 appear to be nothing but a single-piece whole.

To assure the fixation of the element 11 on the body 1, the body 1 has an annular relief 12, the outer diameter of which is substantially equal to the interior diameter of a shoulder 13 that limits the internal edge of the element 11. After the pivot pin 8 is put into place in the cap 3, the element 11 is nested onto the body 1, and the fixation may be reinforced by means of glue, ultrasonic soldering, etc., if the constituent material selected is synthetic.

Figure 5:
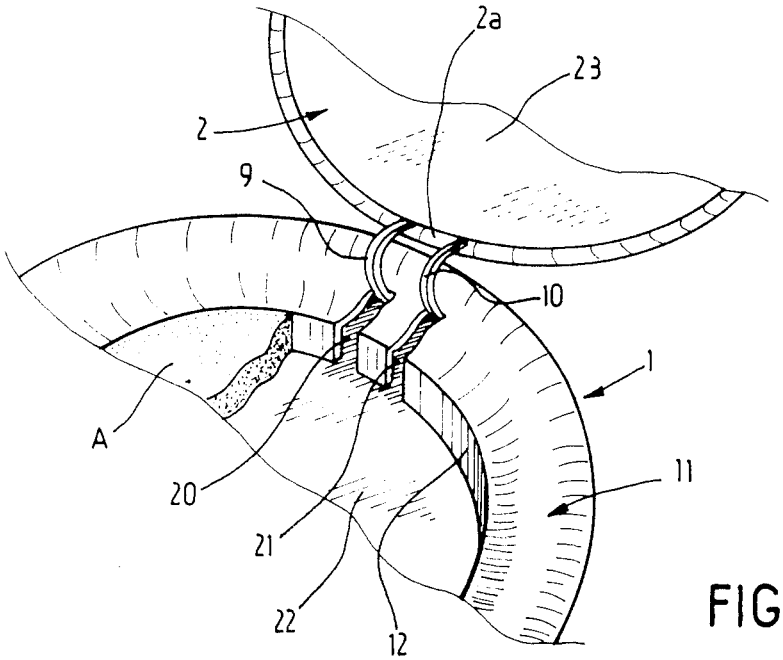
FIG. 5 is a fragmentary schematic perspective view showing a particular embodiment of the invention.

To allow the lid 2 to pivot freely about the pivot pin 8 without having the great length of the element 11, the curved arms 9 and 10 must themselves be capable of displacement. To this end, the element 11 must have an opening at least as large as the distance that separates the outer faces of these arms 9 and 10. In a variant which is shown here and is visible in particular in FIG. 5, the opening comprises two parallel apertures 20 and 21, one curved arm 9–10 extending in each of these apertures.

For esthetic reasons, the apertures 20 and 21 must be as narrow as possible, naturally without impeding the movements of the curved arms 9 and 10. The depth P of the apertures 20 and 21 shown in FIG. 1 must be as great as possible in order to allow a wide clearance of the arms 9 and 10, allowing the lid 2 to be opened at least up to the perpendicular of the plane of the body 1. For the same reason, the arms 9 and 10 are curved, because thus they allow the clearance of the lid 2, although the depth P of the apertures 20 and 21 is necessarily limited by the presence of the pivot pin 8 in the recesses 6 and 7.

Figure 4:
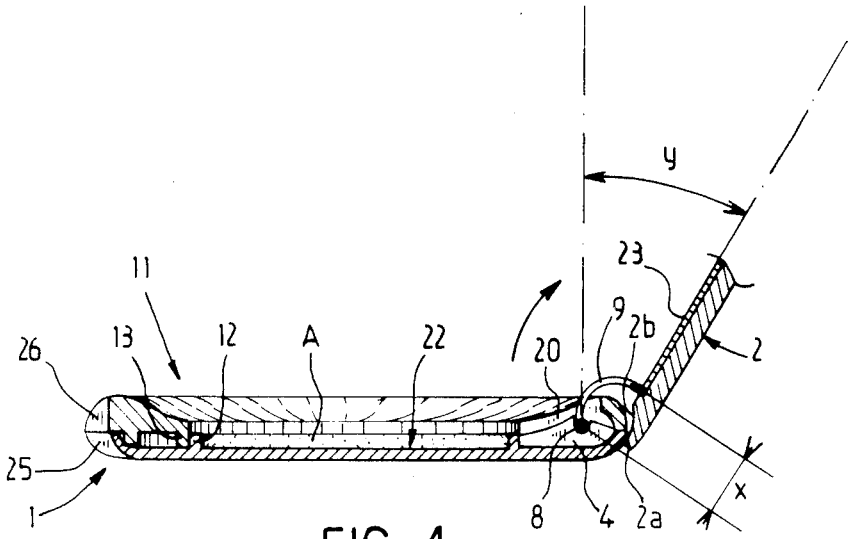
FIG. 4 is a schematic sectional view of the same container after assembly with the lid open.

The apertures 29 and 21 then extend from the base of the element 11, on its inside face and not on its external edge 11*a*, up to this side of this edge. In order that the solid part will not be visible from outside when the lid 2 is in the closing position, the apertures 20 and 21 extend substantially to the top of the element 11, that is, in this case up to its upper generatrix. The curvature of the arms 9 and 10 enables the lid 2, in the opening position, to extend in a plane located beyond this top or generatrix, which is indicated by the angle y (FIG. 4).

Additionally, this curvature enables the arms 9 and 10 never to be located inside the inside edge 14, so that all the internal space can be occupied by compact powder, blusher, makeup brushes, etc., without allowing the movements of the lid 2 to be impeded.

In the closing position of the lid, its zone 2*b* located between the attachment point of the arms 9 and 10 and the outer edge 2*a* is located perpendicular to the swivel joint and hides the top of the apertures 20 and 21. Given the convex curved form of the element 11, the zone 2*b* which must cover it is likewise curved but is concave, which contributes to the attainable magnitude of clearance of the lid 2.

The case shown here is intended for receiving a block A of compact powder, and the body 1 has a uniform bottom 22, but it is self-evident that the invention may have other applications, such as compartmented makeup cases, cigarette cases, and other containers.

When the case is intended for beauty products, the lid 2 may be provided with a mirror 23. For closing it, any known means can be used, and the solution shown here comprises providing a clasp 24 on the lid 2 which is obligated to cooperate by friction or wedging with a seat 25 of corresponding shape provided on the edge of the body 1 opposite the cap 3. When the element 11, as in this case, is the same shape and has the same length as the body 1, a recess 26 must be provided for the passage of the clasp 24.

This case is advantageously made by milling of synthetic material in three pieces: body 1 with cap 3 in one single piece, lid 2 with pivot pin 8 and arms 9–10 as well as clasp 24 in a single piece, and element 11 with its apertures 20–21 and its recess 26. The assembly of these three pieces is easy: The curved arms 9 and 10 engage the apertures 20 and 21 of the element 11, the pivot pin 8 engages the recesses 6 and 7 of the cap 3, and the element 11 is fixed on the body 1. The only finishing needed is to put the possible mirror 23 into place. After that operation, the product or products, in this case the block A of compact powder, need merely be set in place.

What is claimed is:

1. A container of the type including two pivoting parts, such as a body (1) and a lid (2) which are joined to one another by a swivel joint and which are respectively integrally connected with a cap (3) and a pivot pin (8) constrained to interlock in order to determine a pivoting assembly held in place by an element (11) connected on top of said assembly, characterized in that the two pivoting parts (1 and 2) have uninterrupted contours of their outer edges (1*a* and 2*a*) and in that the connected element (11) is provided with at least one internal opening (20–21) enabling the passage of arms (9 and 10) which are integrally connected with the pivot pin (8) and with the lid (2), at a substantial distance (x) from its outer edge (2*a*).

2. A container as defined by claim 1, characterized in that the internal opening (20–21), or each internal opening (20 and 21), as applicable, extends from the lower inside edge of the connected element (11) up to this side of its outer edge (11*a*).

3. A container as defined by claim 1, characterized in that the zone (2*b*) of the lid (2) that is located between the outer edge (2*a*) and the arms (9 and 10) is located perpendicular to the opening or openings (20–21) of the connected element (11) when said lid (2) is in the closing position.

4. A container as defined by claim 1, characterized in that the arms (9 and 10) are curved.

5. A container as defined by claim 1, characterized in that the connected element (11) is provided with one aperture (20–21) for each arm (9–10).

* * * * *